US009373439B2

(12) United States Patent
Powell

(10) Patent No.: US 9,373,439 B2
(45) Date of Patent: Jun. 21, 2016

(54) DIELECTRIC BIASING CIRCUIT FOR TRANSFORMERS AND INDUCTORS

(71) Applicant: The Quest Group, Irvine, CA (US)

(72) Inventor: Garth Judson Powell, Irvine, CA (US)

(73) Assignee: The Quest Group, Irvine, CA (US)

( * ) Notice: Subject to any disclaimer, the term of this patent is extended or adjusted under 35 U.S.C. 154(b) by 64 days.

(21) Appl. No.: 14/020,745

(22) Filed: Sep. 6, 2013

(65) Prior Publication Data

US 2015/0048916 A1 Feb. 19, 2015

Related U.S. Application Data

(60) Provisional application No. 61/886,496, filed on Aug. 15, 2013.

(51) Int. Cl.

| | |
|---|---|
| ***H01F 27/32*** | (2006.01) |
| ***H01F 27/36*** | (2006.01) |
| ***H01F 38/30*** | (2006.01) |
| ***H01F 27/30*** | (2006.01) |
| ***H01F 27/28*** | (2006.01) |
| ***H01F 19/08*** | (2006.01) |

(52) U.S. Cl.

CPC ..... *H01F 27/2885* (2013.01); *H01F 19/08* (2013.01); *H01F 2019/085* (2013.01)

(58) Field of Classification Search

USPC ..... 336/84 R, 84 C, 84 M, 199, 229

See application file for complete search history.

(56) References Cited

U.S. PATENT DOCUMENTS

| | | | | |
|---|---|---|---|---|
| 3,963,975 | A * | 6/1976 | Gauper et al. | 363/15 |
| 4,177,418 | A * | 12/1979 | Brueckner et al. | 323/250 |
| 4,386,333 | A * | 5/1983 | Dillan | 336/107 |
| 4,510,476 | A * | 4/1985 | Clatterbuck et al. | 336/84 C |
| 4,561,707 | A * | 12/1985 | Jackson | 315/209 CD |
| 5,293,145 | A * | 3/1994 | Rynkiewicz | 336/65 |
| 5,615,091 | A * | 3/1997 | Palatnik | 363/17 |
| 6,429,598 | B1 * | 8/2002 | Haley | 315/141 |
| 7,126,055 | B1 | 10/2006 | Low et al. | |
| 2007/0152794 | A1 * | 7/2007 | Chen | 336/212 |
| 2011/0204845 | A1 * | 8/2011 | Paparo et al. | 320/108 |

* cited by examiner

*Primary Examiner* — Tsz Chan

(74) *Attorney, Agent, or Firm* — McDermott Will & Emery LLP

(57) ABSTRACT

A transformer is configured to receive an input electrical signal at input nodes and supply an output electrical signal at output nodes. The transformer includes windings wound on the core between the input and output nodes. The windings define a signal path to transform the input electrical signal into the output electrical signal along the signal path. The transformer includes a first insulated conductive layer arranged between first and second windings configured to receive a first bias voltage. The transformer includes a second insulated conductive layer arranged spatially proximate to the first and second windings configured to receive a second bias voltage. The first and second insulated conductive layers form an electrostatic field that is based on a potential difference between the first and second bias voltages independent of the signal path. The windings are arranged to be within the formed electrostatic field.

22 Claims, 12 Drawing Sheets

DIELECTRIC BIASING CIRCUIT FOR TRANSFORMERS AND INDUCTORS

CROSS-REFERENCE TO RELATED APPLICATIONS

The present application claims the benefit of U.S. Provisional Patent Application Ser. No. 61/866,496, titled "DIELECTRIC BIASING CIRCUIT FOR TRANSFORMERS AND INDUCTORS," filed on Aug. 15, 2013, which is hereby incorporated by reference in its entirety for all purposes.

FIELD

The present disclosure relates to electrical power systems, and more particularly a dielectric biasing circuit for the electro-magnetic used in alternating current devices.

BACKGROUND

Electrical power devices that provide energy signal transmission, including transformers and choke circuits, can be impacted by radio frequency noise and distortion. Design and performance aspects of the transformers and chokes also include "run-in time." Run-in time refers to the process by which a transformer and/or a choke come to a stable electrical state. In this regard, the run-in time may refer to the gradual forming of electrical properties in the transformers and chokes. As such, the amount of time it takes to form the electrical properties may impact the performance of the transformers and chokes.

SUMMARY

According to some implementations, a transformer is configured to receive an input electrical signal at input nodes and supply an output electrical signal at output nodes. The transformer includes windings wound on the core between the input and output nodes. The windings define a signal path to transform the input electrical signal into the output electrical signal along the signal path. The transformer includes a first insulated conductive layer arranged between first and second windings configured to receive a first bias voltage. The transformer includes a second insulated conductive layer arranged spatially proximate to the first and second windings configured to receive a second bias voltage. The first and second insulated conductive layers form an electrostatic field that is based on a potential difference between the first and second bias voltages independent of the signal path. The windings are arranged to be within the formed electrostatic field.

In some aspects, a transformer includes a core, input nodes and output nodes. The transformer is configured to receive an input electrical signal at the input nodes and supply an output electrical signal at the output nodes via a conduction path formed between the input and output nodes. The transformer includes windings wound on the core and coupled to the input nodes and output nodes. The windings are configured to transform the input electrical signal into the output electrical signal along the conduction path. The transformer includes a insulated conductive layer arranged between first and second windings of the windings configured to receive a first bias voltage. The transformer includes a conductive enclosure arranged over and around the windings configured to receive a second bias voltage. The insulated conductive layer and conductive enclosure form an electrostatic field that is based on a potential difference between the first and second voltages independent of the conduction path. The windings are arranged to be within the formed electrostatic field.

In one or more implementations, an inductive device includes an input node and an output node. The inductive device is configured to receive an input electrical signal at the input node and supply an output electrical signal at the output node. The inductive device includes a core disposed between the input node and the output node. The inductive device includes a winding wound on the core defining a signal path to communicate the output electrical signal based on the input electrical signal along the signal path. The inductive device includes a insulated conductive layer arranged between the core and the winding configured to receive a first voltage to form an electrostatic field based on a potential difference between the first voltage and a second voltage independent of the signal path. The winding is arranged to be within the formed electrostatic field.

Additional features and advantages of the subject technology will be set forth in the description below, and in part will be apparent from the description, or may be learned by practice of the subject technology. The advantages of the subject technology will be realized and attained by the structure particularly pointed out in the written description and claims hereof as well as the appended drawings.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide further understanding of the subject technology and are incorporated in and constitute a part of this specification, illustrate aspects of the subject technology and together with the description serve to explain the principles of the subject technology.

DETAILED DESCRIPTION

The detailed description set forth below is intended as a description of 1 Various configurations of the subject technology and is not intended to represent the only configurations in which the subject technology may be practiced. The appended drawings are incorporated herein and constitute a part of the detailed description. The detailed description includes specific details for the purpose of providing a thorough understanding of the subject technology. However, the subject technology is not limited to the specific details set forth herein and may be practiced without some of these specific details. In certain instances, structures and components are shown in block diagram form in order to avoid obscuring the concepts of the subject technology.

Figure 1:
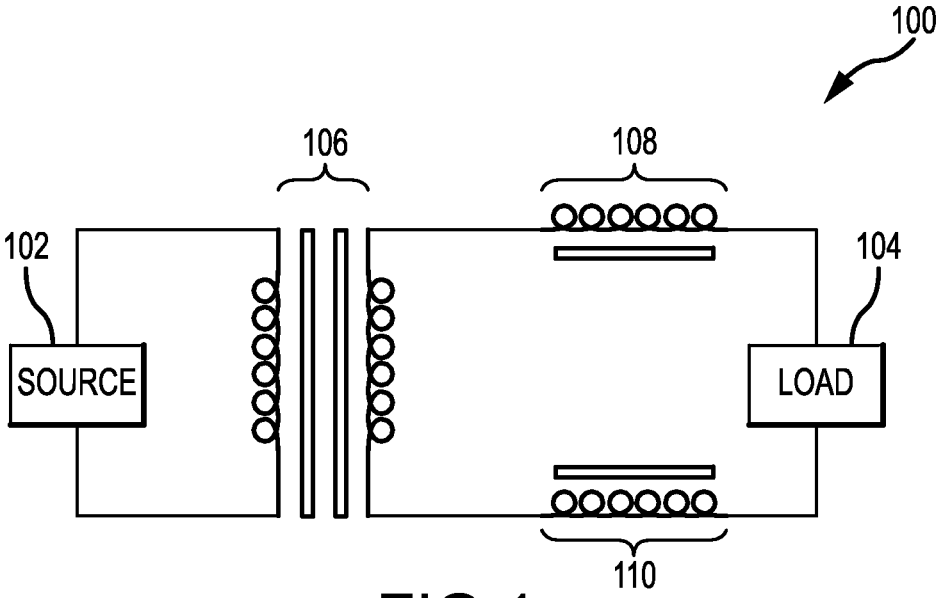
FIG. 1 is a block diagram illustrating a power system, in accordance with various aspects of the subject technology.

FIG. 1 is a block diagram illustrating a power system 100, in accordance with various aspects of the subject disclosure. Not all of the depicted components may be required, however, and one or more implementations may include additional components not shown in the figure. Variations in the arrangement and type of the components may be made without departing from the spirit or scope of the claims as set forth herein. Additional components, different components, or fewer components may be provided.

Power system 100 includes source 102, load 104, transformer 106 and series chokes 108 and 110. As shown in FIG. 1, series chokes 108 and 110 are connected in series between transformer 106 and load 104. Transformer 106 supplies an electrical signal from source 102 to load 104 via series chokes 108 and 110.

Source 102 may be configured to provide an alternating current (AC) signal that is transformed into the electrical signal for load 104. In some aspects, source 102 may include an AC power supply that is configured to supply the AC signal. In some implementations, source 102 may be configured to receive the AC signal from an external AC power supply. As used herein, the term "AC signal" may sometimes be referred to as a "voltage varying electrical signal," and both terms may be used interchangeably.

Load 104 may include audio, video, or data transmission circuitry. Load 104 may represent high-fidelity audio and video equipment that requires AC signaling from source 102. By way of illustration, audio, video or data transmission signals may be communicated between high-fidelity audio equipment and video components interconnected in a residential or commercial entertainment system as part of load 104. In this respect, any RF noise or distortion present in the electrical signal can impact the performance of the equipment. As such, an electrical signal with minimized noise and distortion is desirable.

In some aspects, transformer 106 is configured to provide (or supply) AC power to load 104. Transformer 106 may transform the AC signal from source 102 and supply a transformed version of the AC signal with less (or greater) voltage to load 104. In this respect, transformer 106 may up-convert the AC signal having a first voltage (e.g., 100 volts (V) AC) to a second voltage (e.g., 400 VAC). In some aspects, transformer 106 includes multiple windings that are wound on a core having ferrous material or non-ferrous material. Transformer 106 also may include one or more faraday shields (or screens) disposed between the core and transformer windings or disposed within the transformer windings.

Non-limiting examples of transformer 106 include, but are not limited to, an AC power transformer, an AC isolation transformer, a video signal transformer, an audio signal transformer, an AC power filter transformer, an AC power supply transformer.

Series chokes 108 and 110 may attenuate (or filter) frequency components carried in the electrical signal. In some aspects, series chokes 108 and 110 are connected in series between transformer 106 and load 104, where choke 108 is connected in series between a positive terminal of transformer 106 and a positive terminal of load 104, and choke 110 is connected in series between a negative terminal of transformer 106 and a negative terminal of load 104. The series chokes 108 and 110 may be connected in series between source 102 and load 104 without transformer 106 included in power system 100. In some aspects, series chokes 108 and 110 are connected between source 102 and transformer 106, where series chokes 108 and 110 feed primary windings of transformer 106, and secondary windings of transformer 106 feed load 104.

Series chokes 108 and 110 may be configured to block high-frequency AC signals from passing to load 104. As such, series chokes 108 and 110 may reduce the amount of RF noise and distortion in the electrical signal. As will be discussed in more detail below, series chokes 108 and 110 may be passive inductors wound on a core that contains ferrous material or non-ferrous material.

Transformer 106 and series chokes 108 and 110 can each experience a "run-in time" that is a process by which transformer 106 and series chokes 108 and 110 arrive to a stable electrical state. Prior to the stable electrical state, transformer 106 and series chokes 108 and 110 may have formed non-linear electrical characteristics that can impact performance. As AC power is applied to transformer 106 or series chokes 108 and 110, and each is powered on, energy signal transmission properties may be optimized when the stable electrical state has been reached. However, the run-in time to reach the stable electrical state can be significant.

As such, the present disclosure provides dielectric biasing to facilitate the optimization of energy signal transmission properties in transformer 106 and/or series chokes 108 and 110. As will be discussed in further detail, the dielectric biasing may improve the run-in time by reducing the amount of time it takes to reach the stable electrical state. In this respect, reaching the stable electrical state allows for the reduction of unwanted electrical properties, such as RF noise and distortion, in the signal transmission from transformer 106 or series chokes 108 and 110.

Figure 2A:
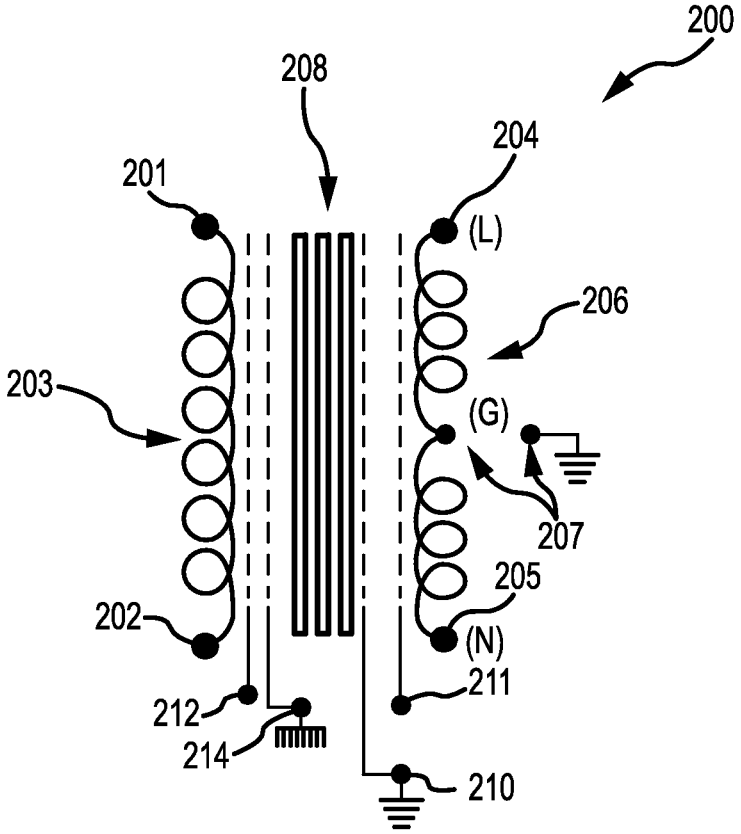
FIGS. 2A-2C are circuit diagrams illustrating examples of dielectric biased transformers, in accordance with various aspects of the subject technology.
Figure 2B:
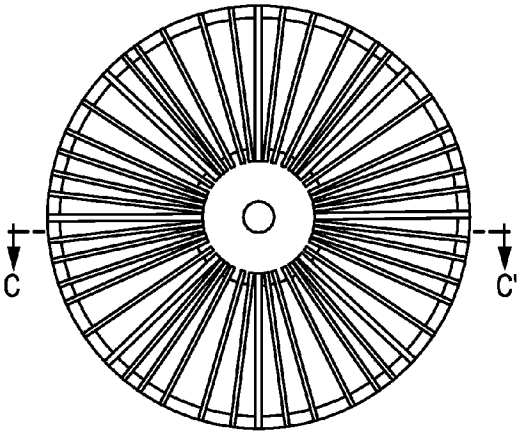
Figure 2C:
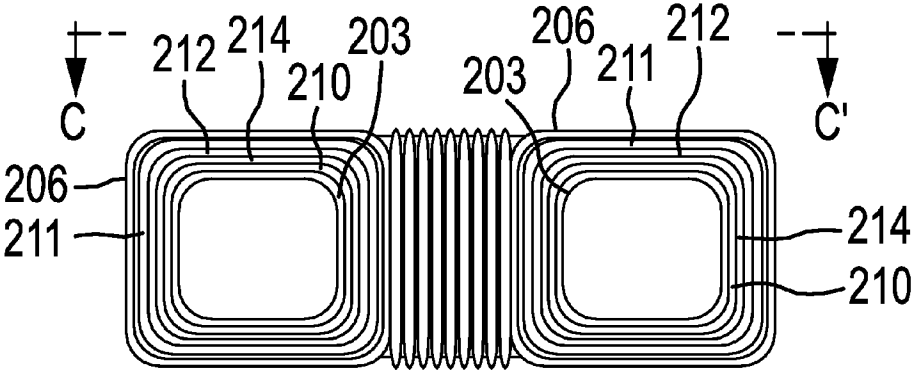

FIGS. 2A-2C are circuit diagrams illustrating examples of a dielectric biased transformer 200, in accordance with various aspects of the subject technology, where FIG. 2A shows a conceptual diagram of the dielectric biased transformer 200, FIG. 2B shows a top-view illustration of the dielectric biased transformer, and FIG. 2C shows a cross-section view of the dielectric biased transformer 200. Not all of the depicted components may be required, however, and one or more implementations may include additional components not shown in the figure. Variations in the arrangement and type of the components may be made without departing from the spirit or scope of the claims as set forth herein. Additional components, different components, or fewer components may be provided.

Referring to FIG. 2A, transformer 200 includes input nodes 201 and 202, primary winding 203, output nodes 204 and 205, secondary winding 206, tap node 207, core 208, and insulated conductive layer1 210-212 and 214.

Core 208 is disposed between input nodes 201 and 202 and output nodes 204 and 205. In some aspects, core 208 is a bobbin or toroid. Core 208 may be manufactured of a ferrous material. In this regard, core 208 may be formed as a ferromagnetic core having a metal alloy. In some aspects, core 208 is non-ferromagnetic. In this regard, core 208 may sometimes be referred to as an air-core.

Primary and secondary windings 203 and 206 may include multiple windings (e.g., three or more windings) over and around core 208. In some implementations, primary and secondary windings 203 and 206 are shaped (or formed) as coils.

Primary and secondary windings 203 and 206 include a conductor through which the AC signal travels, and the conductor may be insulated by an insulation layer (not shown) composed of dielectric material. As will be discussed in further detail below, the dielectric material may be biased by an electrostatic field formed to reduce the amount of noise or distortion the AC signal may experience while traveling through the primary and secondary windings 203 and 206. In this regard, with the reduced noise and distortion, the AC signal can travel through the primary and secondary windings 203 and 206 more efficiently.

In some aspects, primary and secondary windings 203 and 206 define a signal path to transform the input electrical signal into the output electrical signal along the signal path. In this respect, the signal path may travel from primary winding 203 (sometimes referred to as a first winding) to secondary winding 206 (sometimes referred to as a second winding). The signal path may provide signal transmission of sensitive electrical signals directed to audio, video and/or data transmission systems. The signal path may include undesirable electrical properties that impact the integrity of the signal transmission from transformer 200. As will be discussed in further detail below, dielectric biasing may be applied to (or impressed on) insulated conductive layers 210 and 211 using first and second voltages to form an electrostatic field such that the undesirable electrical properties present in the signal path can be removed and allow components within transformer 200 to reach the stable electrical state sooner.

In some aspects, tap node 207 is arranged at a location on secondary winding 206 that is centered between output nodes 204 and 205. In this regard, tap node 207 is sometimes referred to as a center tap. Given the central location of tap node 207, tap node 207 may also serve as an AC virtual ground. In this respect, the potential observed at tap node 207 may not vary, thus providing a virtual ground reference. In some implementations, tap node 207 is disposed at a different location along secondary winding 206 than shown in FIG. 2A. In this regard, tap node 207 may be located towards output node 204 from the central location, or may be located towards output node 205 from the central location. The tap node 207 may be coupled to a ground return path of a DC voltage supply, a connection to an electrical ground or chassis earth ground.

Transformer 200 is configured to receive an input electrical signal at input nodes 201 and 202, and configured to supply an output electrical signal at output nodes 204 and 205. Input node 201 and output node 204 may sometimes be referred to as a line input node and line output node, respectively, to denote "hot" wires or leads. Input node 202 and output node 205 may sometimes be referred to as a neutral input node and neutral output node, respectively. Tap node 207 may sometimes be referred to as a ground lead.

By way of illustration, input node 201 may be configured to receive the input electrical signal having a voltage in a range of 100 volts (V) AC to 480 VAC, while input node 202 may be configured to receive the input electrical signal having a voltage at zero potential (e.g., 0 VAC). Transformer 200 may be configured to convert the input electrical signal into the output electrical signal having a different voltage. As such, output node 204 may be configured to supply the output electrical signal having a voltage in a range of 1 VAC to 400 VAC. Similarly, output node 205 may be configured to supply the output electrical signal at a voltage in the same range (e.g., from 1 VAC to 400 VAC).

In some aspects, insulated conductive layers 210-212 and 214 contain insulation material to maintain isolation from neighboring components in transformer 200. In some aspects, insulated conductive layers 210-212 and 214 are faraday screens or shields. In this regard, insulated conductive layers 210-212 and 214 may be implemented using a single turn or multiple turns of any suitable conductive material (e.g., copper, aluminum, aluminum foil). The insulated conductive layers 210-212 and 214 may suppress interferences that could be transmitted from coil to coil or winding to winding if one or more of the insulated conductive layers 210-212 and 214 are earthed (e.g., coupled to an electrical ground or chassis earth ground).

Here, insulated conductive layer 210 is arranged between primary and secondary windings 203 and 206. Insulated conductive layer 210 may be disposed adjacent to primary winding 203 such that insulated conductive layer 210 is arranged over primary winding 203. In this regard, insulated conductive layer 210 serves as a second layer over core 208 with primary winding 203 serving as a first layer over core 208. In some aspects, insulated conductive layer 210 may be coupled to tap node 207 to serve as a secondary ground at DC.

Insulated conductive layer 214 may be arranged spatially proximate to core 208 and primary and secondary windings 203 and 206. In some aspects, insulated conductive layer 214 is positioned adjacent to insulated conductive layer 210 such that insulated conductive layer 214 is arranged over insulated conductive layer 210. In this regard, insulated conductive layer 214 serves as a third layer over core 208. Insulated conductive layer 214 may be positioned next to insulated conductive layer 210 with one or more intermediate components (e.g., screen, shield, mesh, adhesive, or similar physical item) disposed between insulated conductive layer 210 and insulated conductive layer 214.

Insulated conductive layer 212 may be arranged spatially proximate to core 208 and primary and secondary windings 203 and 206. In some aspects, insulated conductive layer 212 is positioned adjacent to insulated conductive layer 214 such that insulated conductive layer 212 is arranged over insulated conductive layer 214. In this regard, insulated conductive layer 212 serves as a fourth layer over core 208. Insulated conductive layer 212 may be positioned next to insulated conductive layer 214 with one or more intermediate components (e.g., screen, shield, mesh, adhesive, or similar physical item) disposed between insulated conductive layer 214 and insulated conductive layer 212.

Insulated conductive layer 211 may be arranged spatially proximate to insulated conductive layer 212 and primary and secondary windings 203 and 206. In some aspects, insulated conductive layer 211 is positioned adjacent to insulated conductive layer 212 such that insulated conductive layer 211 is arranged over insulated conductive layer 212. In this regard, insulated conductive layer 211 serves as a fifth layer over core 208. Insulated conductive layer 211 may be positioned next to insulated conductive layer 212 with one or more intermediate components (e.g., screen, shield, mesh, adhesive, or similar physical item) disposed between insulated conductive layer 212 and insulated conductive layer 211.

In some aspects, insulated conductive layer 210 is configured to receive a ground return path of a DC voltage supply. In certain aspects, insulated conductive layer 214 is configured to receive a ground earth potential. In certain implementations, insulated conductive layers 211 and 212 are configured to receive respective DC voltages. The first voltage applied to insulated conductive layer 211 may be in a range of 1 volt (V) to 1000 V. Similarly, the second voltage applied to insulated conductive layer 212 may be in a range of 1 volt (V) to 1000 V.

When a DC voltage is applied to each of insulated conductive layers 211 and 212, there is a DC electro-static potential between insulated conductive layers 212 and 214, as well as between insulated conductive layers 210 and 211, which causes the dielectric material included in primary and secondary windings 203 and 206 to become charged. When charged by the DC electro-static potential, primary and secondary windings 203 and 206 can experience a stable electrical state sooner such that any undesirable electrical properties in the signal path are reduced (or eliminated) at a faster rate, thus allowing the overall performance of transformer 200 to improve at the same rate.

Insulated conductive layers 212 and 214, when electrically biased with respective supply voltages, form a first electrostatic field independent of the signal path (e.g., the AC voltage conduction path present in primary and secondary windings 203 and 206, AC input nodes 201 and 202 and AC output nodes 204 and 205), which is based on a potential difference between second and third voltages (e.g., the earth ground chassis as the second voltage and the DC voltage as the third voltage). In this respect, the third voltage is in a range of 1 volt (V) to 1000 VDC.

Insulated conductive layers 210 and 211, when electrically biased with respective supply voltages, form a second electrostatic field independent of the signal path that is based on a potential difference between first and fourth voltages (e.g., the ground return path as the first voltage and the DC voltage as the fourth voltage).

By having the DC electro-static field present, the capacitive elements in primary and secondary windings 203 and 206 may be charged to the stable electrical state. Having the capacitive elements at or around the saturation level, the "run-in time" (or amount of time to reach the stable electrical state) can be significantly reduced, thus improving the quality of the signal transmission along the signal path. Furthermore, having the molecules of the capacitive elements polarized with respect to the electrostatic field, improvement in the signal integrity can be realized.

By way of illustration, the electrostatic field rearranges or aligns molecules of the capacitive elements associated with primary and secondary windings 203 and 206, for example, from a relatively random order to a relatively uniform order to facilitate communication of a higher quality electrical signal. In other words, the dielectric biasing electrostatically organizes or polarizes molecules of the capacitive elements present in primary and secondary windings 203 and 206 relative to the electrostatic field created by the biased insulated conductive layers such that the dielectric biasing is not a source of current in the signal path. The dielectric biasing of transformer 200 may continually place all the capacitive elements present in transformer 200 into a comparatively high voltage DC field.

As the potential difference between insulated conductive layers 210 and 211, for example, increases above the signal voltage level, signal quality along the signal path increases. The upper voltage (e.g., 1000 VDC) is not intended to be limited to a specific voltage. However, the use of a bias voltage to bias insulated conductive layers 210 and 211, for example, may depend on various factors including: (1) the degree of signal transmission quality for any given difference in voltage between the dielectric in insulated conductive layers 210 and 211 and the transmitted signal, (2) an acceptable level of performance based at least in part on consumer expectation for a specific application, (3) associated manufacturing and consumer costs, and (4) safety related issues regarding the use of 1 Various voltages. Similar behavior may be experienced with the potential difference between insulated conductive layers 212 and 214.

In some aspects, as tap node 207 is a ground potential, and as input node 202 (e.g., neutral lead) of primary winding 203 is also at earth ground at a circuit breaker box (e.g., electrical source from a wall tap), there is also a DC electro-static potential between insulated conductive layer 212 and input node 202 at the earth ground potential, which dielectrically charges the stray capacitance in primary winding 203. In addition, there is also a DC electro-static potential between insulated conductive layer 211 and tap node 207, which dielectrically charges the stray capacitance in secondary winding 206 since tap node 207 is at the ground potential (e.g., 0 VAC).

Referring to FIG. 2B, transformer 200 is shown in a top view with no cut-away. Here, transformer 200 has a circular diameter, where secondary winding 206 is arranged over primary winding 203 and insulated conductive layers 210-212 and 214 (not shown). Referring to FIG. 2C, transformer 200 is shown in a side view with a cut-away to illustrate the arrangement of layers including primary and secondary windings 203 and 206 and insulated conductive layers 210-212 and 214.

As shown in FIG. 2C, core 208 is surrounded by primary winding 203 to serve as the first layer over core 208. In some aspects, primary winding 203 has two (2) leads (e.g., line and neutral). Primary winding 203 is surrounded by insulated conductive layer 210 to serve as the second layer over core 208, which may be configured to receive a ground potential. Insulated conductive layer 210 is surrounded by insulated conductive layer 214 to serve as the third layer over core 208, which may be configured to receive an earth ground potential. Insulated conductive layer 214 is surrounded by insulated conductive layer 212 to serve as the fourth layer over core 208, which may be configured to receive a DC voltage supply (e.g., in a range of 1 to 1000 VDC). Insulated conductive layer 212 is surrounded by insulated conductive layer 211 to serve as the fifth layer over core 208, which may be configured to receive a DC voltage supply in the same range as insulated conductive layer 212. Insulated conductive layer 211 is surrounded by secondary winding 206. In some aspects, secondary winding 206 has three (3) leads (e.g., line, ground and neutral).

Figure 3:
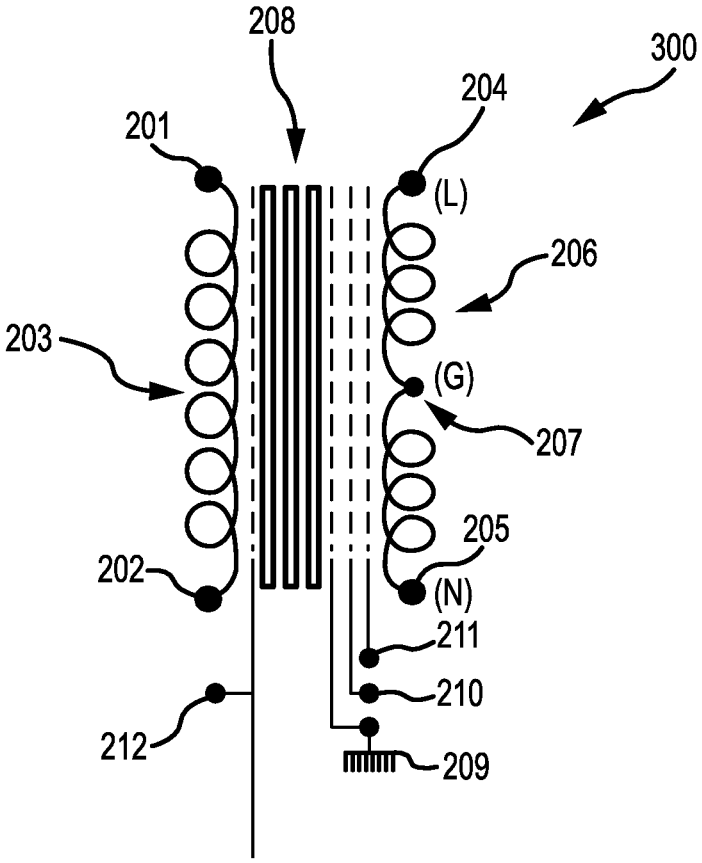
FIGS. 3-9 are circuit diagrams illustrating examples of dielectric biased transformers, in accordance with various aspects of the subject technology.

FIG. 3 is a circuit diagram illustrating an example of a dielectric biased transformer 300, in accordance with various aspects of the subject technology. Not all of the depicted components may be required, however, and one or more implementations may include additional components not shown in the figure. Variations in the arrangement and type of the components may be made without departing from the spirit or scope of the claims as set forth herein. Additional components, different components, or fewer components may be provided.

Because transformer 300 is substantially similar to transformer 200 of FIG. 2A, only differences will be discussed with respect to FIG. 3. Transformer 300 includes input nodes 201 and 202, primary winding 203, output nodes 204 and 205, secondary winding 206, tap node 207, core 208, and insulated conductive layers 209-212. In some aspects, insulated conductive layer 214 (not shown) is arranged adjacent to insulated conductive layer 212.

Here, insulated conductive layer 209 is arranged between primary and secondary windings 203 and 206 and over core 208. In some aspects, insulated conductive layer 209 is positioned adjacent to insulated conductive layer 210 such that insulated conductive layer 209 is arranged underneath insulated conductive layer 210. In this regard, insulated conductive layer 209 may serve as a second layer over core 208 while insulated conductive layer 210 serves as a third layer over core 208. Insulated conductive layer 209 may be positioned next to insulated conductive layer 210 with one or more intermediate components (e.g., screen, shield, mesh, adhesive, or similar physical item) disposed between insulated conductive layer 210 and insulated conductive layer 209. In certain aspects, insulated conductive layer 209 is configured to receive a ground earth potential. Insulated conductive layer 209 may be coupled to a chassis earth ground node, which may float from a potential other than zero potential or an earth ground reference.

In this regard, a DC electrostatic field (or electrostatic potential) may be formed between insulated conductive layers 209 and 211 to electrostatically polarize the capacitive elements associated with primary and secondary windings 203 and 206. In some aspects, a DC electro-static potential may exist between insulated conductive layers 210 and 211.

As discussed above, insulated conductive layers 210 and 211, when applied with respective bias voltages, form an electrostatic field independent of the signal path that is based on a potential difference between the respective voltages. In this regard, the electrostatic field can have an effect on capacitive elements (e.g., capacitance by design, parasitic capacitance, stray capacitance) associated with primary and secondary windings 203 and 206. The capacitive elements are charged to a stable electrical state based on the electrostatic field. Particularly, the capacitive elements can be charged to a saturation level that prevents unnecessary discharges to occur during signal transmission, which can impact performance and signal integrity.

In some aspects, insulated conductive layer 209 contains insulation material to maintain isolation from neighboring components in transformer 200. In some aspects, insulated conductive layer 209 is a faraday screen or shield. In this regard, insulated conductive layer 209 may be implemented using multiple turns of copper or aluminum foil. The insulated conductive layer 209 may suppress interferences that could be transmitted from coil to coil or winding to winding if insulated conductive layer 209 is earthed (e.g., coupled to an electrical ground or chassis earth ground).

Figure 4:
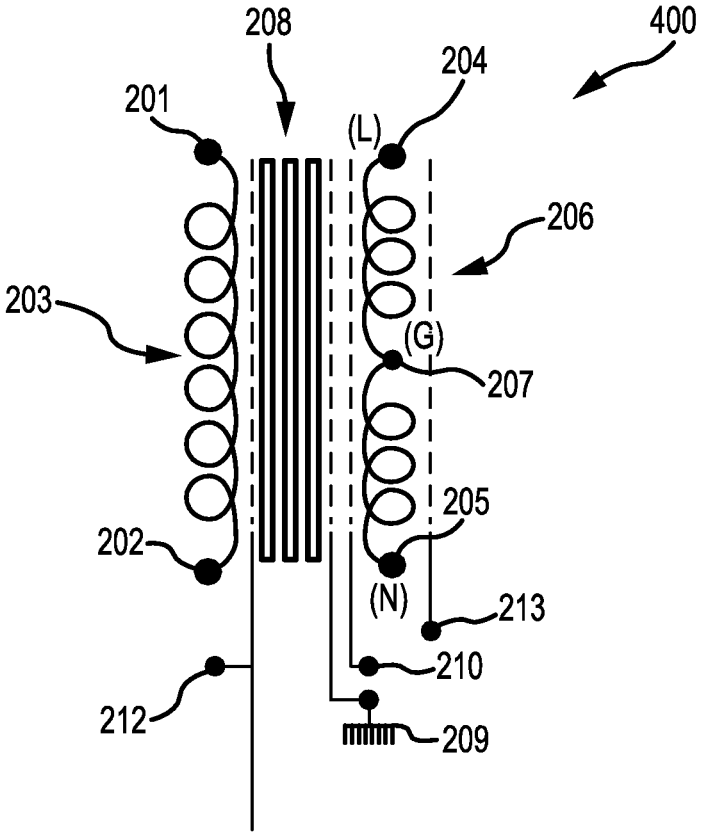

FIG. 4 is a circuit diagram illustrating an example of a dielectric biased transformer 400, in accordance with various aspects of the subject technology. Not all of the depicted components may be required, however, and one or more implementations may include additional components not shown in the figure. Variations in the arrangement and type of the components may be made without departing from the spirit or scope of the claims as set forth herein. Additional components, different components, or fewer components may be provided.

Because transformer 400 is substantially similar to transformer 200 of FIG. 2A, only differences will be discussed with respect to FIG. 4. Transformer 400 includes input nodes 201 and 202, primary winding 203, output nodes 204 and 205, secondary winding 206, tap node 207, core 208, and insulated conductive layers 209, 210, 212 and 213. In some aspects, insulated conductive layer 214 (not shown) is arranged adjacent to insulated conductive layer 212. In certain implementations, insulated conductive layer 211 (not shown) is arranged adjacent to insulated conductive layer 212.

Here, insulated conductive layer 213 is arranged over primary and secondary windings 203 and 206. In some aspects, insulated conductive layer 213 is positioned adjacent to secondary winding 206 such that insulated conductive layer 213 serves as a sixth layer over core 208 while secondary winding 206 serves as a fifth layer over core 208. Insulated conductive layer 213 may be positioned next to secondary winding 206 with one or more intermediate components (e.g., screen, shield, mesh, adhesive, or similar physical item) disposed between insulated conductive layer 213 and secondary winding 206. In certain aspects, insulated conductive layer 213 is configured to receive a DC voltage supply (e.g., in a range of 1 V to 1000 VDC).

In this regard, a DC electrostatic field (or electrostatic potential) may be formed between insulated conductive layer 213 and 209 to electrostatically polarize the capacitive elements associated with primary and secondary windings 203 and 206. In some aspects, a DC electro-static potential may exist between insulated conductive layers 213 and 210. In addition, a DC electro-static potential may exist between insulated conductive layers 212 and 209.

As discussed above, insulated conductive layers 213 and 209, when applied with respective bias voltages, form an electrostatic field independent of the signal path that is based on a potential difference between the respective voltages. In this regard, the electrostatic field can have an effect on capacitive elements (e.g., capacitance by design, parasitic capacitance, stray capacitance) associated with primary and secondary windings 203 and 206. The capacitive elements are charged to a stable electrical state based on the electrostatic field. Particularly, the capacitive elements can be charged to a saturation level that prevents unnecessary discharges to occur during signal transmission, which can impact performance and signal integrity.

In some aspects, insulated conductive layer 213 contains insulation material to maintain isolation from neighboring components in transformer 200. In some aspects, insulated conductive layer 213 is a faraday screen or shield. In this regard, insulated conductive layer 213 may be implemented using multiple turns of copper or aluminum foil. The insulated conductive layer 213 may suppress interferences that could be transmitted from coil to coil or winding to winding if insulated conductive layer 213 is earthed (e.g., coupled to an electrical ground or chassis earth ground).

Figure 5:
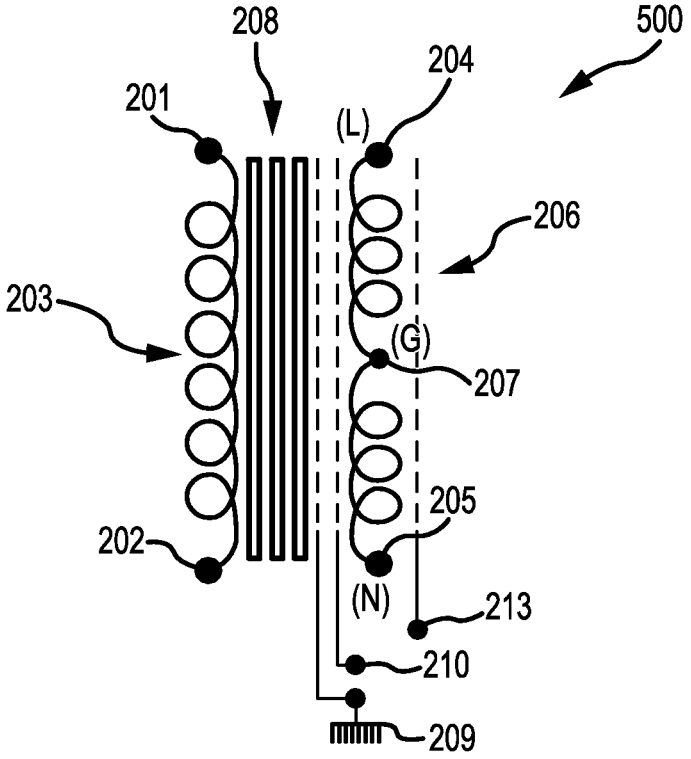

FIG. 5 is a circuit diagram illustrating an example of a dielectric biased transformer 500, in accordance with various aspects of the subject technology. Not all of the depicted components may be required, however, and one or more implementations may include additional components not shown in the figure. Variations in the arrangement and type of the components may be made without departing from the spirit or scope of the claims as set forth herein. Additional components, different components, or fewer components may be provided.

Because transformer 500 is substantially similar to transformer 200 of FIG. 2A, only differences will be discussed with respect to FIG. 5. Transformer 500 includes input nodes 201 and 202, primary winding 203, output nodes 204 and 205, secondary winding 206, tap node 207, core 208 and insulated conductive layers 209, 210 and 213. In some aspects, insulated conductive layer 214 (not shown) is arranged adjacent to insulated conductive layer 210. In certain implementations, insulated conductive layer 212 (not shown) is arranged over and proximate to insulated conductive layer 210. In certain aspects, insulated conductive layer 211 (not shown) is arranged proximate and over insulated conductive layer 210.

In this regard, a DC electrostatic field (or electrostatic potential) may be formed between insulated conductive layer 213 and 209 to electrostatically polarize the capacitive elements associated with primary and secondary windings 203 and 206. In some aspects, a DC electro-static potential may exist between insulated conductive layers 213 and 210.

Figure 6:
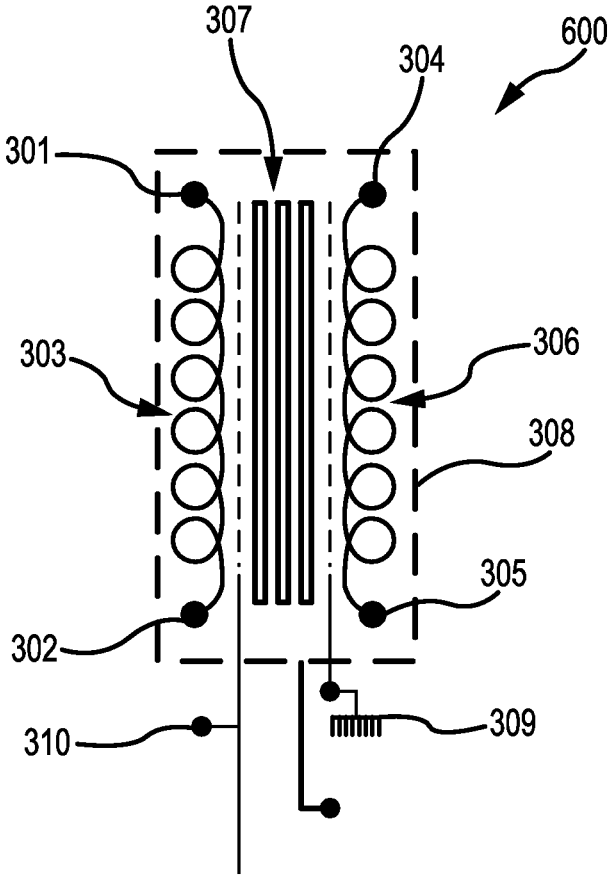

FIG. 6 is a circuit diagram illustrating an example of a dielectric biased transformer 600, in accordance with various aspects of the subject technology. Not all of the depicted components may be required, however, and one or more implementations may include additional components not shown in the figure. Variations in the arrangement and type of the components may be made without departing from the spirit or scope of the claims as set forth herein. Additional components, different components, or fewer components may be provided.

Transformer 600 includes input nodes 301 and 302, primary winding 303, output nodes 304 and 305, secondary winding 306, core 307, and insulated conductive layers 308-310.

Primary and secondary windings 303 and 306 are wound on core 307, and coupled to input nodes 301 and 302 and output nodes 304 and 305. Primary and secondary windings 303 and 306 may include multiple windings (e.g., three or more windings) over and around core 307. In some implementations, primary and secondary windings 303 and 306 may be shaped (or formed) as coils.

Primary and secondary windings 303 and 306 include a conductor through which the AC signal travels, and the conductor is insulated by an insulation layer composed of dielectric material. As will be discussed in further detail below, the dielectric material may be biased by an electrostatic field formed to reduce the amount of noise or distortion the AC signal may experience while traveling through primary and secondary windings 303 and 306.

In some aspects, primary and secondary windings 303 and 306 define a signal path to transform the input electrical signal into the output electrical signal along the signal path. In this respect, the signal path may travel from primary winding 303 (sometimes referred to as a first winding) to secondary winding 306 (sometimes referred to as a second winding). The signal path may provide signal transmission of a high-electrical signal directed to audio, video and/or data transmission systems. The signal path may include undesirable electrical properties that impact the integrity of the signal transmission from transformer 300. As will be discussed in further detail, transformer 300 is enhanced with dielectric biasing such that the undesirable electrical properties present in the signal path can be removed and allow transformer 300 to reach an electrical steady state sooner.

Core 307 is disposed between input nodes 301 and 302 and output nodes 304 and 305. In some aspects, core 307 may be a bobbin or toroid. Core 307 may be manufactured of a ferrous material. In this regard, core 307 may be formed as a ferromagnetic core having a metal alloy. In some aspects, core 307 may be non-ferromagnetic.

Transformer 600 is configured to receive an input electrical signal at input nodes 301 and 302, and configured to supply an output electrical signal at output nodes 304 and 305. Input node 301 and output node 304 may sometimes be referred to as a line input node and line output node, respectively, to denote "hot" wires or leads. Input node 302 and output node 305 may sometimes be referred to as a neutral input node and neutral output node, respectively. Tap node 307 may sometimes be referred to as a ground lead.

By way of illustration, input node 301 is configured to receive the input electrical signal having a voltage in a range of 100 volts (V) AC to 480 VAC, while input node 302 is configured to receive the input electrical signal having a voltage at zero potential (e.g., 0 VAC). Transformer 300 may be configured to convert the input electrical signal into the output electrical signal having a different voltage. As such, output node 304 may be configured to supply the output electrical signal having a voltage in a range of 2 VAC to 600 VAC. Alternatively, output node 305 may be configured to supply the output electrical signal at zero potential.

In some aspects, insulated conductive layers 308-310 contain insulation material to maintain isolation from neighboring components in transformer 600. In some aspects, insulated conductive layers 308-310 are faraday screens or shields. In this regard, insulated conductive layers 308-310 may be implemented using a single turn or multiple turns of any suitable conductive material (e.g., copper, aluminum, aluminum foil).

As shown in FIG. 6, insulated conductive layer 308 is arranged over primary and secondary windings 303 and 306. In some aspects, insulated conductive layer 308 is positioned adjacent to secondary winding 306 such that insulated conductive layer 308 serves as a fifth layer over core 307 while secondary winding 306 serves as a fourth layer over core 307. Insulated conductive layer 308 may be positioned next to secondary winding 306 with one or more intermediate components (e.g., screen, shield, mesh, adhesive, or similar physical item) disposed between insulated conductive layer 308 and secondary winding 306. In certain aspects, insulated conductive layer 308 is configured to receive a DC voltage supply (e.g., in a range of 1 V to 1000 VDC).

Here, insulated conductive layer 309 is arranged between primary and secondary windings 303 and 306 and over core 307. In some aspects, insulated conductive layer 309 is positioned adjacent to primary winding 303 such that insulated conductive layer 309 serves as a second layer over core 307 while primary winding 303 serves as a first layer over core 307. Insulated conductive layer 309 may be positioned next to primary winding 303 with one or more intermediate components (e.g., screen, shield, mesh, adhesive, or similar physical item) disposed between insulated conductive layer 309 and primary winding 303. In certain aspects, insulated conductive layer 309 is configured to receive an electrical ground or chassis earth ground reference (e.g., 0 VDC).

Here, insulated conductive layer 310 is arranged between primary and secondary windings 303 and 306 and over core 307. In some aspects, insulated conductive layer 310 is positioned adjacent to secondary winding 306 such that insulated conductive layer 310 serves as a third layer over core 307 while secondary winding 306 serves as a fourth layer over core 307. Insulated conductive layer 310 may be positioned next to secondary winding 306 with one or more intermediate components (e.g., screen, shield, mesh, adhesive, or similar physical item) disposed between insulated conductive layer 310 and secondary winding 306. In certain aspects, insulated conductive layer 310 is configured to receive a DC voltage supply (e.g., in a range of 1 V to 1000 VDC).

Insulated conductive layers 308 and 309 are configured to receive respective bias voltages (e.g., supply voltages). When a supply voltage is applied to each of insulated conductive layers 308 and 309, a potential difference between the respective voltages causes the dielectric material included in primary and secondary windings 303 and 306 to become charged. When charged by the bias voltages, primary and secondary windings 303 and 306 can reach the stable electrical state sooner. In this regard, any undesirable electrical properties in the signal path can be reduced (or eliminated) at a faster rate, thus allowing the overall performance of transformer 600 to improve at the same rate.

Insulated conductive layers 308 and 309, when electrically biased, form an electrostatic field independent of the signal path that is based on a potential difference between the respective voltages. In this respect, the electrostatic field can have an effect on capacitive elements (e.g., capacitance by design, parasitic capacitance) associated with primary and secondary windings 303 and 306. The capacitive elements are charged to a stable electrical state based on the electrostatic field. Particularly, the capacitive elements can be charged to a saturation level that prevents unnecessary discharges to occur during signal transmission, which can impact performance and signal integrity.

In some aspects, as output node 305 of secondary winding 306 is at ground potential, and as input node 302 (e.g., neutral lead) of primary winding 303 is also at earth ground at a circuit breaker box (e.g., electrical source from a wall tap), there is also a DC electro-static potential between insulated conductive layer 310 and input node 302 at the earth ground potential, which dielectrically charges the stray capacitance in primary winding 303. In addition, there is also a DC electro-static potential between insulated conductive layer 308 and output node 305, which dielectrically charges the stray capacitance in secondary winding 306 since output node 305 is at the ground potential (e.g., 0 VAC).

Figure 7:
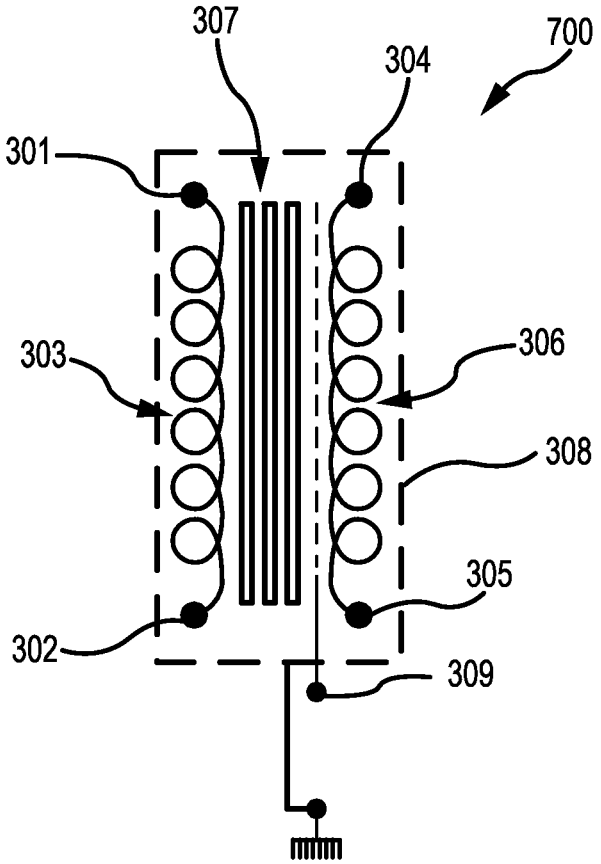

FIG. 7 is a circuit diagram illustrating an example of a dielectric biased transformer 700, in accordance with various aspects of the subject technology. Not all of the depicted components may be required, however, and one or more implementations may include additional components not shown in the figure. Variations in the arrangement and type of the components may be made without departing from the spirit or scope of the claims as set forth herein. Additional components, different components, or fewer components may be provided.

Because transformer 700 is substantially similar to transformer 600 of FIG. 6, only differences will be discussed with respect to FIG. 7. Transformer 700 includes input nodes 301 and 302, primary winding 303, output nodes 304 and 305, secondary winding 306, core 307, and insulated conductive layers 308 and 309. In some aspects, insulated conductive layer 310 (not shown) is arranged adjacent to insulated conductive layer 309.

Here, insulated conductive layer 308 is configured to receive an earth ground potential (e.g., chassis ground or electrical ground). On the other hand, insulated conductive layer 309 is configured to receive a DC voltage supply (e.g., in a range of 1 V to 1000 VDC). In this regard, a DC electrostatic field (or electrostatic potential) may be formed between insulated conductive layers 308 and 309 to electrostatically polarize the capacitive elements associated with primary and secondary windings 303 and 306.

In some aspects, as output node 305 of secondary winding 306 is at ground potential, and as input node 302 (e.g., neutral lead) of primary winding 303 is also at earth ground at a circuit breaker box (e.g., electrical source from a wall tap), there is also a DC electro-static potential between insulated conductive layer 309 and input node 302 at the earth ground potential, which dielectrically charges the stray capacitance in primary winding 303. In addition, there is also a DC electro-static potential between insulated conductive layer 309 and output node 305, which dielectrically charges the stray capacitance in secondary winding 306 since output node 305 is at the ground potential (e.g., 0 VAC).

Figure 8:
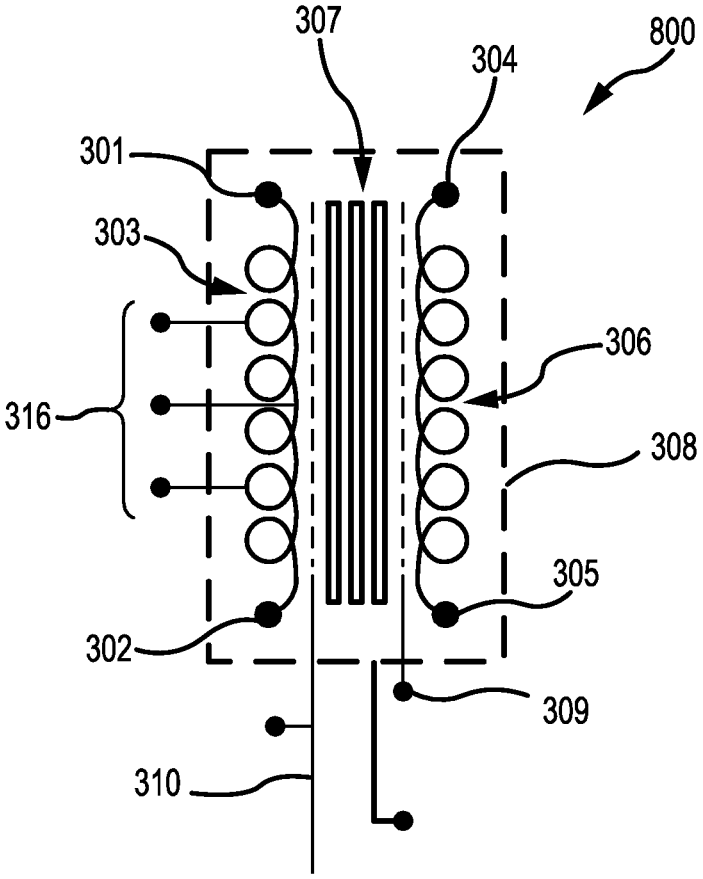

FIG. 8 is a circuit diagram illustrating an example of a dielectric biased transformer 800, in accordance with various aspects of the subject technology. Not all of the depicted components may be required, however, and one or more implementations may include additional components not shown in the figure. Variations in the arrangement and type of the components may be made without departing from the spirit or scope of the claims as set forth herein. Additional components, different components, or fewer components may be provided.

Because transformer 800 is substantially similar to transformer 200 of FIG. 2A, only differences will be discussed with respect to FIG. 8. Transformer 800 includes input nodes 301 and 302, primary winding 303, output nodes 304 and 305, secondary winding 306, core 307, and insulated conductive layers 308-310.

Transformer 800 also includes electrical inputs 316 coupled to primary winding 303, in which each of electrical inputs 316 is configured to receive a respective voltage signal and supply the respective voltage signal to primary winding 303. Electrical inputs 316 may be coupled to specific locations along primary winding 303. In some aspects, transformer 340 includes three electrical inputs. There may be less than (or greater than) number of electrical inputs than shown in FIG. 8, and are not intended to limit the scope of the subject disclosure. The respective voltage signals may be high (or logical '1') or low (or logical '0') DC signals. That is, each of electrical inputs 316 can apply a DC voltage to primary winding 303.

By way of illustration, input nodes 301 and 302 may be configured to receive the input electrical signal having a same voltage. In some aspects, input nodes 301 and 302 may be configured to receive the input electrical signal having different voltages. Transformer 800 may be configured to convert the input electrical signal into the output electrical signal having a different voltage from the input electrical signal. Given the electrical inputs at primary winding 303, output node 304 may be configured to supply the output electrical signal as a high signal (e.g., logical 1) and output node 305 may be configured to supply the output electrical signal as a low signal (e.g., logical 0).

Here, insulated conductive layer 308 is configured to receive a DC voltage supply (e.g., in a range of 1 V to 1000 VDC). On the other hand, insulated conductive layers 309 and 310 are configured to receive a ground return path of a DC voltage supply (e.g., 0 VDC). In this regard, a DC electrostatic field (or electrostatic potential) may be formed between insulated conductive layers 308 and 309 to electrostatically polarize the capacitive elements associated with primary and secondary windings 303 and 306. In addition, a DC electro-static potential may be formed between insulated conductive layers 308 and 310.

Figure 9:
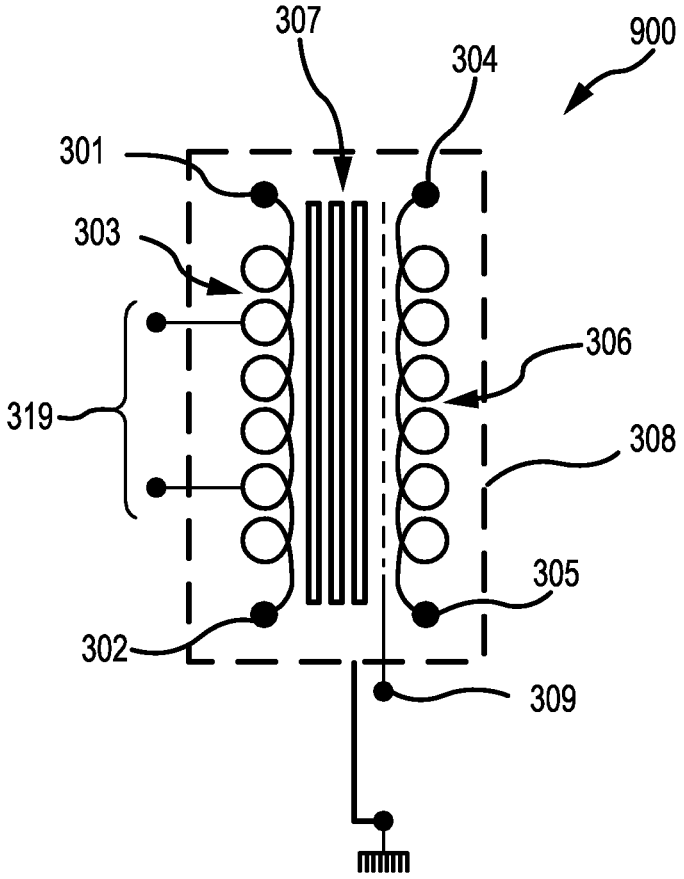

FIG. 9 is a circuit diagram illustrating an example of a dielectric biased transformer 900, in accordance with various aspects of the subject technology. Not all of the depicted components may be required, however, and one or more implementations may include additional components not shown in the figure. Variations in the arrangement and type of the components may be made without departing from the spirit or scope of the claims as set forth herein. Additional components, different components, or fewer components may be provided.

Because transformer 900 is substantially similar to transformer 800 of FIG. 8, only differences will be discussed with respect to FIG. 9. Transformer 300 includes input nodes 301 and 302, primary winding 303, output nodes 304 and 305, secondary winding 306, core 307, and insulated conductive layers 308 and 309. In some aspects, insulated conductive layer 310 (not shown) is arranged adjacent to insulated conductive layer 309.

Transformer 360 also includes electrical inputs 319 coupled to primary winding 303, in which each of electrical inputs 319 is configured to receive a respective voltage signal and supply the respective voltage signal to primary winding 303. Electrical inputs 319 may be coupled to specific locations along primary winding 303. In some aspects, transformer 340 includes three electrical inputs. There may be less than (or greater than) number of electrical inputs than shown in FIG. 9, and are not intended to limit the scope of the subject disclosure. The respective voltage signals may be high (or logical '1') or low (or logical '0') DC signals. That is, each of electrical inputs 319 can apply a DC voltage to primary winding 303.

Here, insulated conductive layer 308 is configured to receive an earth ground potential (e.g., chassis ground or electrical ground). On the other hand, insulated conductive layer 309 is configured to receive a DC voltage supply (e.g., in a range of 1 V to 1000 VDC). In this regard, a DC electrostatic field (or electrostatic potential) may be formed between insulated conductive layers 308 and 309 to electrostatically polarize the capacitive elements associated with primary and secondary windings 303 and 306.

Figure 10:
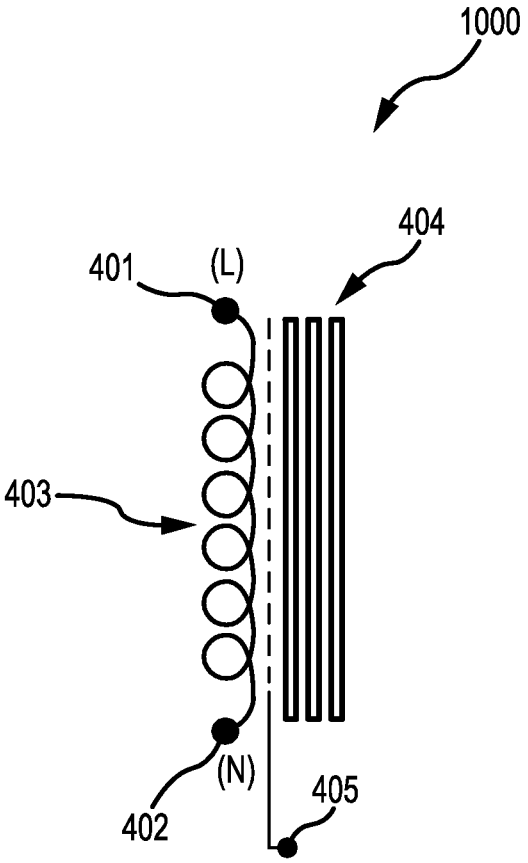
FIGS. 10 and 11 are circuit diagrams illustrating examples of dielectric biased inductive devices, in accordance with various aspects of the subject technology.

FIG. 10 is a circuit diagram illustrating an example of a dielectric biased inductive device 1000, in accordance with various aspects of the subject technology. Not all of the depicted components may be required, however, and one or more implementations may include additional components not shown in the figure. Variations in the arrangement and type of the components may be made without departing from the spirit or scope of the claims as set forth herein. Additional components, different components, or fewer components may be provided.

Inductive device 1000 includes input node 401, output node 402, winding 403, core 404 and insulated conductive layer 405. Inductive device 1000 is configured to receive an input electrical signal at input node 401, and configured to supply an output electrical signal at output node 402.

By way of illustration, input node 401 may be configured to receive the input electrical signal having a voltage in a range of 5 volts (V) AC to 480 VAC. Inductive device 1000 may be configured to pass input electrical signal into the output electrical signal having a different voltage. In some aspects, the output electrical signal may have a same voltage as the input electrical signal at output node 402.

Winding 403 may include multiple windings (e.g., three or more windings) over and around core 404. In some implementations, winding 403 is physically shaped (or formed) into multiple coils. In some aspects, winding 403 defines a signal path to transform the input electrical signal into the output electrical signal along the signal path. The signal path may provide signal transmission of a high-electrical signal directed to audio, video and/or data transmission systems. The signal path may include undesirable electrical properties that impact the integrity of the signal transmission from inductive device 1000. As will be discussed in further detail, inductive device 1000 is enhanced with dielectric biasing such that the undesirable electrical properties present in the signal path can be removed and allow inductive device 1000 to reach an electrical steady state sooner.

Core 404 may be a bobbin or toroid. Core 404 may be manufactured of a ferrous material. In this regard, core 404 may be formed as a ferromagnetic core having a metal alloy. In some aspects, core 404 is non-ferromagnetic.

Insulated conductive layer 405 is arranged between core 404 and winding 403 configured to receive a first voltage. As shown in FIG. 4A, the first voltage applied to insulated conductive layer 405 may be in a range of 1 volt (V) to 1000 V. In this respect, the first voltage is a direct current (DC) voltage.

In some aspects, insulated conductive layer 405 includes an insulation layer that isolates insulated conductive layer 405 from one or more components of inductive device 1000. Core 404 may include an insulation layer that encloses core 404. In this regard, insulated conductive layer 405 may be coupled to the insulation layer of core 404, and may be implemented as a connector (or lead) from the insulation layer of core 404.

Winding 403 has dielectric material that may be impacted by a bias voltage (e.g., a DC voltage) as applied to insulated conductive layer 405. When charged by a bias voltage, the potential difference created between applied bias voltages causes winding 403 to reach the stable electrical state sooner. In this regard, any undesirable electrical properties in the signal path can be reduced (or eliminated) at a faster rate, thus allowing the overall performance of inductive device 1000 to improve at the same rate.

Here, insulated conductive layer 405, when electrically biased, forms an electrostatic field independent of the signal path that is based on a potential difference between the first voltage and a second voltage applied to the conductive chassis of inductive device 1000. Winding 403 may be electrically biased such that the electrostatic field has an effect on capacitive elements (e.g., capacitance by design, parasitic capacitance) associated with winding 403 and/or one or more components of inductive device 1000. In this regard, the capacitive elements in winding 403 can be charged to a saturation level, thus reaching the stable electrical state to prevent unnecessary discharges to occur during signal transmission, which can impact performance and signal integrity.

Figure 11:
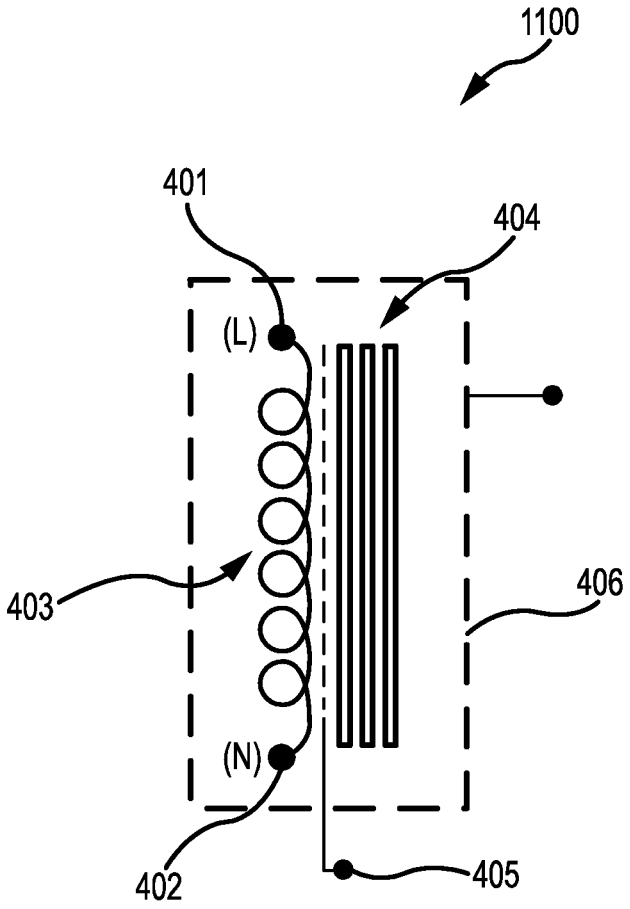

FIG. 11 is a circuit diagram illustrating an example of a dielectric biased inductive device 1100, in accordance with various aspects of the subject technology. Not all of the depicted components may be required, however, and one or more implementations may include additional components not shown in the figure. Variations in the arrangement and type of the components may be made without departing from the spirit or scope of the claims as set forth herein. Additional components, different components, or fewer components may be provided.

Because inductive device 1100 is substantially similar to inductive device 1000 of FIG. 10, only differences will be discussed with respect to FIG. 11. Inductive device 1100 includes input node 401, output node 402, winding 403, core 404, and insulated conductive layers 405 and 406.

Dielectric biasing may be applied to (or impressed on) insulated conductive layers 405 and 406 using first and second voltages such that the undesirable electrical properties present in the signal path can be removed and allow inductive device 1100 to reach the stable electrical state sooner. As shown in FIG. 11, the first voltage applied to insulated conductive layer 405 is at zero potential and the second voltage applied to insulated conductive layer 406 may be in a range of 1 volt (V) to 1000 V.

Insulated conductive layers 405 and 406, when electrically biased, form an electrostatic field independent of the signal path that is based on a potential difference between the first and the inductor signal potential when inductive device 1100 is utilized for AC neutral or ground, thus completing the DC potential and creating an electrostatic field. Insulated conductive layer 406 may be utilized outside of winding 403 to form the negative return for the DC voltage required for the electrostatic charge (and necessary if inductive device 1100 is utilized for the AC line lead (or input node 402)).

In some aspects, insulated conductive layer 405 may be arranged between winding 403 and core 404, while insulated conductive layer 406 is arranged over and around winding 403. In this regard, insulated conductive layer 406 may be implemented as an insulated conductive case or material covering inductive device 1100, in part or in its entirety. Insulated conductive layer 405 may be implemented as an insulated conductive material or lead connector from core 404 that is implemented as an insulated conductive core.

It is understood that any specific order or hierarchy of blocks, modules, elements, components, and methods in the processes disclosed is an illustration of example approaches. Based upon design preferences, it is understood that the specific order or hierarchy of blocks in the processes may be rearranged, or that all illustrated blocks be performed. Any of the blocks may be performed simultaneously. Moreover, the separation of 1 Various system components in the embodiments described above should not be understood as requiring such separation in all embodiments, and it should be understood that the described electrical circuits can generally be integrated together in a single electrical device or packaged into multiple electrical devices.

Phrases such as an aspect, the aspect, another aspect, some aspects, one or more aspects, an implementation, the implementation, another implementation, some implementations, one or more implementations, an embodiment, the embodiment, another embodiment, some embodiments, one or more embodiments, a configuration, the configuration, another configuration, some configurations, one or more configurations, the subject technology, the disclosure, the present disclosure, other variations thereof and alike are for convenience and do not imply that a disclosure relating to such phrase(s) is essential to the subject technology or that such disclosure applies to all configurations of the subject technology. A disclosure relating to such phrase(s) may apply to all configurations, or one or more configurations. Such disclosure may provide one or more examples. A phrase such as an aspect may refer to one or more aspects and vice versa, and this applies similarly to other phrases.

Furthermore, to the extent that the term "include," "have," or the like is used in the description or the claims, such term is intended to be inclusive in a manner similar to the term "comprise" as "comprise" is interpreted when employed as a transitional word in a claim.

All structural and functional equivalents to the elements of the various aspects described throughout this disclosure that are known or later come to be known to those of ordinary skill in the art are expressly incorporated herein by reference and are intended to be encompassed by the claims. Moreover, nothing disclosed herein is intended to be dedicated to the public regardless of whether such disclosure is explicitly recited in the claims. No claim element is to be construed under the provisions of 35 U.S.C. §112, sixth paragraph, unless the element is expressly recited using the phrase "means for" or, in the case of a method claim, the element is recited using the phrase "step for."

The previous description is provided to enable any person skilled in the art to practice the various aspects described herein. Various modifications to these aspects will be readily apparent to those skilled in the art, and the generic principles defined herein may be applied to other aspects. Thus, the claims are not intended to be limited to the aspects shown herein, but are to be accorded the full scope consistent with the language claims, wherein reference to an element in the singular is not intended to mean "one and only one" unless specifically so stated, but rather "one or more." Unless specifically stated otherwise, the term "some" refers to one or more. Pronouns in the masculine (e.g., his) include the feminine and neuter gender (e.g., her and its) and vice versa. Headings and subheadings, if any, are used for convenience only and do not limit the subject disclosure.

What is claimed is:

1. An alternating current (AC) transformer comprising:

a plurality of input nodes;

a plurality of output nodes, wherein the transformer is configured to receive an input AC electrical signal at the plurality of input nodes and supply an output AC electrical signal at the plurality of output nodes;

a core;

a plurality of windings wound on the core and arranged between the plurality of input nodes and plurality of output nodes, the plurality of windings defining an AC signal path to transform the input AC electrical signal into the output AC electrical signal along the AC signal path, the plurality of input nodes being coupled to a first winding of the plurality of windings and the plurality of output nodes being coupled to a second winding of the plurality of windings;

a first faraday screen disposed between the core and the second winding, the first faraday screen being coupled to a first bias direct current (DC) voltage; and a second faraday screen disposed between the first faraday screen and the core, the second faraday screen being coupled to a return path of the first bias DC voltage, wherein the first and second faraday screens form a DC electrostatic field independent of the AC signal path, the DC electrostatic field being formed based on a potential difference between the first and second faraday screens, wherein the first and second faraday screens are disposed between the first and second windings for biasing capacitive elements associated with the plurality of windings using the formed DC electrostatic field.

2. The AC transformer of claim 1, further comprising a third faraday screen disposed between the core and the second winding, the third faraday screen being coupled to a second bias DC voltage.

3. The AC transformer of claim 2, wherein the third faraday screen is configured to provide a second DC electrostatic field independent of the AC signal path based on a potential difference between the third faraday screen and a fourth faraday screen.

4. The AC transformer of claim 3, wherein the fourth faraday screen is disposed between the first and second windings and coupled to a return path of the second bias DC voltage.

5. The AC transformer of claim 4, wherein the second faraday screen is disposed over and adjacent to the first winding that is arranged adjacent to the core, wherein the fourth faraday screen is disposed over and adjacent to the second faraday screen, wherein the third faraday screen is disposed over and adjacent to the fourth faraday screen, and wherein the first faraday screen is disposed over and adjacent to the third faraday screen.

6. The AC transformer of claim 5, wherein the first and second bias DC voltages are each in a range of 1 volt (V) to 1000 V.

7. The AC transformer of claim 4, wherein the second faraday screen is arranged over and adjacent to the first winding, wherein the fourth faraday screen is arranged over and adjacent to the second faraday screen, wherein the first faraday screen is arranged over and adjacent to the fourth faraday screen, wherein the third faraday screen is arranged over and adjacent to the core, and wherein the first winding is arranged over and adjacent to the third faraday screen.

8. The AC transformer of claim 7, wherein the second faraday screen is coupled to a chassis earth ground potential, wherein the first and second bias DC voltages are each in a range of 1 volt (V) to 1000 V.

9. The AC transformer of claim 4, wherein the second faraday screen is arranged over and adjacent to the first winding, wherein the fourth faraday screen is arranged over and adjacent to the second faraday screen, wherein the first faraday screen is arranged over the fourth faraday screen and adjacent to the second winding, wherein the third faraday screen is arranged over and adjacent to the core, and wherein the first winding is arranged over and adjacent to the third faraday screen.

10. The AC transformer of claim 9, wherein the second faraday screen is coupled to a chassis earth ground potential, wherein the first and second bias DC voltages are each in a range of 1 volt (V) to 1000 V.

11. The AC transformer of claim 4, wherein the second faraday screen is arranged over and adjacent to the first winding, wherein the fourth faraday screen is arranged over and adjacent to the second faraday screen, wherein the first faraday screen is arranged over the fourth faraday screen and adjacent to the second winding, and wherein the first winding is arranged adjacent to the core.

12. The AC transformer of claim 11, wherein the second faraday screen is coupled to a chassis earth ground potential, wherein the first bias voltage is in a range of 1 volt (V) to 1000 V.

13. The AC transformer of claim 1, further comprising a tap node at a location on the second winding between the plurality of output nodes having zero potential, wherein the second faraday screen is coupled to the tap node.

14. The AC transformer of claim 1, wherein the plurality of input nodes comprises a line input node that is configured to receive the input AC electrical signal at a voltage in a range of 100 V to 480 V and a neutral input node that is configured to receive the input AC electrical signal at a voltage with zero potential.

15. The AC transformer of claim 10, wherein the plurality of output nodes comprises a line output node and a neutral output node that are each configured to supply the output electrical signal at a voltage in a range of 1 V to 400 V.

16. An alternating current (AC) inductive device comprising an input node;

an output node, wherein the inductive device is configured to receive an input AC electrical signal at the input node and supply an output AC electrical signal at the output node;

a core;

a winding wound on the core defining an AC signal path to communicate the output AC electrical signal based on the input AC electrical signal along the AC signal path; and a faraday screen disposed on the core, the faraday screen being coupled to a first direct current (DC) voltage to form a DC electrostatic field independent of the AC signal path, the DC electrostatic field being formed based on a potential difference between the faraday screen and the core, the core being coupled to a return path of the first DC voltage, wherein the faraday screen is disposed between the winding and the core for biasing capacitive elements associated with the winding using the formed DC electrostatic field.

17. The AC inductive device of claim 16, wherein the first DC voltage is in a range of 1 volt (V) to 1000 V.

18. The AC inductive device of claim 16, further comprising:

a conductive enclosure disposed over and around the winding to enclose the AC inductive device.

19. The AC inductive device of claim 18, wherein the conductive enclosure is configured to receive a second DC voltage in a range of 1 volt (V) to 1000 V.

20. The AC inductive device of claim 19, wherein the first DC voltage is at zero potential.

21. The AC inductive device of claim 16, wherein the input AC electrical signal has a voltage that is in a range of 5 volts (V) to 480 V.

22. The AC inductive device of claim 16, wherein the core comprises an insulation layer that encloses the core, wherein the faraday screen is coupled to the insulation layer of the core and is configured to provide a lead connection from the insulation layer of the core.

* * * * *